United States Patent [19]

Robin et al.

[11] 4,387,670

[45] Jun. 14, 1983

[54] COOLING SYSTEMS FOR INTERNAL COMBUSTION ENGINE COMPRISING A RADIATOR EQUIPPED WITH AN EXPANSION-TANK

[75] Inventors: Roger Robin, Elencourt; Ngy S. Ap, Montfermeil, both of France

[73] Assignee: Valeo, Paris, France

[21] Appl. No.: 265,253

[22] Filed: May 19, 1981

[30] Foreign Application Priority Data

May 20, 1980 [FR] France ..... 80 11227

[51] Int. Cl.[3] ..... F01P 7/16

[52] U.S. Cl. ..... 123/41.08; 123/41.15

[58] Field of Search ..... 123/41.27, 41.08, 41.2, 123/41.15

[56] References Cited

U.S. PATENT DOCUMENTS

| | | | |
|---|---|---|---|
| 1,900,586 | 3/1933 | Rippe | 123/41.44 |
| 2,408,374 | 10/1946 | Clapsadle et al. | 123/41.21 |
| 2,597,061 | 5/1952 | Burich | 123/41.08 |
| 2,637,308 | 5/1953 | Dodge | 123/41.08 |
| 3,162,182 | 12/1964 | Gratzmuller | 123/41.08 |
| 3,662,820 | 5/1972 | Myer | 123/41.27 X |
| 3,759,233 | 9/1973 | Schlaffer et al. | 123/41.08 |
| 3,981,279 | 9/1976 | Bubniak et al. | 123/41.08 |

*Primary Examiner*—William A. Cuchlinski, Jr.
*Attorney, Agent, or Firm*—Wigman & Cohen

[57] ABSTRACT

Combustion engine cooled by circulation of liquid in a main circuit which includes a pump and a radiator associated with an expansion-tank. Auxiliary piping connects the expansion-tank to a suitable point in the main circuit in order to inject into it a flow of cold liquid coming from the expansion-tank and delivered through an auxiliary pump.

8 Claims, 1 Drawing Figure

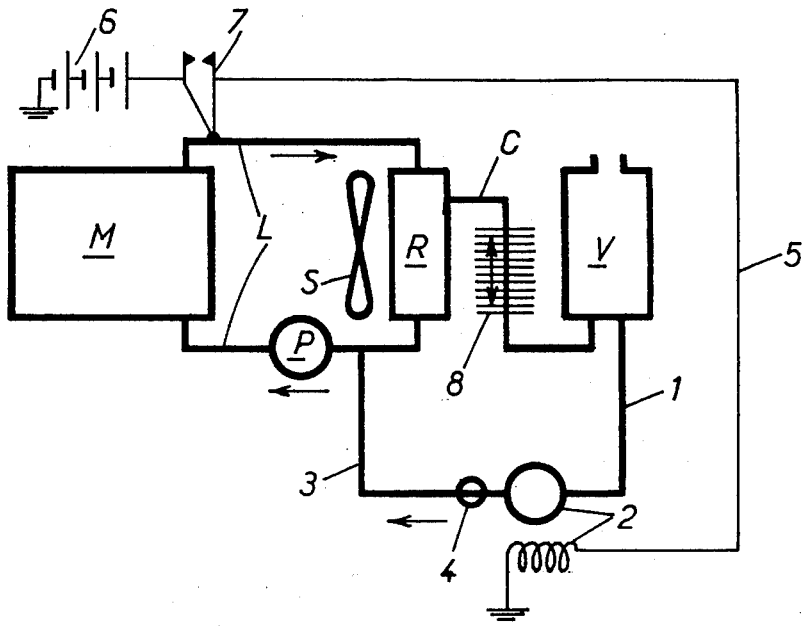
6
7
C
M
L
R
V
5
S
P
8
1
3
2
4

COOLING SYSTEMS FOR INTERNAL COMBUSTION ENGINE COMPRISING A RADIATOR EQUIPPED WITH AN EXPANSION-TANK

BACKGROUND OF THE INVENTION

1. Field of the Invention

The present invention is more particularly applicable to a conventional cooling system for an internal combustion engine, comprising especially:

- a pump for water or other cooling liquid, having a mechanical drive;
- a fan having an electrical or directly mechanical or declutchable drive;
- a radiator equipped with a cap which may or may not be calibrated; and
- an expansion-tank equipped with a cap which may or may not be calibrated.

2. Description of the Prior Art

In the motorcar industry it has already been proposed a very long time ago to have the expansion of the cooling liquid of the engine absorbed by an expansion-tank, as in current fixed heating installations. The French Pat. No. 1.269.341 of the 2nd of July 1960 describes such a radiator system associated with an expansion-tank.

Sometimes with such a conventional system, violent overheating is found after the engine has operated at full load for a long time, for example, while running along a motorway or while climbing a long hill slope, one stops for some reason or other (toll-house, customs, rest area), because of the reduction in ventilation. Experience proves that the return from running at full load to slow running is accompanied by supplementary energy which must be removed, as compared with stabilized slow running. This phenomenon is known by the name of "thermal inertia" of the engine. It is characterized by two main parameters:

- the time constant;
- the energy relating to the thermal inertia of the engine.

This energy is of the order of 60 to 90 kcal (for an engine of 7 to 10 HP) and hence might heat 1 kg of water from 0° C. up to 60° to 90° C. From the standpoint of the energy, the thermal inertia does not present any importance; on the contrary, from the standpoint of the power, because of the time constant, it represents up to the order of magnitude of the power of the radiator in stabilized slow running (about 5000 kcal/h).

However, for a conventional cooling circuit assembly as above, slightly under-dimensioned or correctly dimensioned with respect to stabilized slow running, the thermal inertia of the engine at the time of passing from full load running to unexpected slow running, brings about a rise in the temperature of the cooling liquid of the engine. This rise lasts for a long time and may reach the boiling point, which causes disastrous consequences.

SUMMARY OF THE INVENTION

The present invention is aimed, without involving any serious modification of a conventional installation, at preventing or at least reducing this rise in temperature, and in order to do that, at absorbing or very rapidly consuming this energy due to the thermal inertia.

It consists essentially in injecting at the inlet to the engine (for example, at the suction or delivery side of the pump for the cooling liquid) a very small delivery of the order of 25 to 90 l/h of cold cooling liquid, that is to say, at a temperature close to ambient, which is available in the expansion-tank which generally contains only 1 to 2 liters. For this purpose, auxiliary piping connects the expansion-tank to a point in the main circuit which includes the radiator and the circulating pump, in order to inject into it cold liquid coming from the expansion-tank and delivered through an auxiliary pump.

Inasmuch as in stabilized slow running, the pump in the cooling circuit does not have at its disposal a sufficient suction pressure, the injection of the cooling liquid from the expansion-tank to the engine is effected by a small auxiliary pump, for example, an electric pump of very small size such as that of the electrical pump of the windscreen washer.

It will be observed that the whole of the auxiliary injection circuit of the present invention which is of low weight and small bulk may easily be added on to a conventional installation already existing, without necessitating modifications having to be applied to its design or to its organization.

The description which is to follow with respect to the attached drawing, given by way of non-restrictive example, will let it clearly be understood how the invention may be realized.

BRIEF DESCRIPTION OF THE DRAWINGS

The sole FIGURE is a diagram of a cooling circuit improved in accordance with an embodiment of the present invention.

In order the better to pick out the special inventive features from the conventional surroundings already existing, they will be designated below by reference numbers, reference letters being reserved for the known arrangements of the prior art. Furthermore the pipework for water or other liquid is drawn in thick line, whilst the electrical connections are drawn in thin lines.

DETAILED DESCRIPTION OF THE PREFERRED EMBODIMENT

In the drawing there is seen the internal combustion engine M of a car with its cooling circuit L of water or some other liquid, comprising a radiator R having horizontal or vertical circulation and a main circulating pump P, generally driven by the engine M. As described in the French Patent mentioned above, the top portion of the radiator R—which may be its inlet (as illustrated) or outlet header—is connected through a pipe C to the bottom portion of an expansion-tank V which is freely open to the atmosphere (as shown) or equipped with a calibrated cap (not shown). Facing the radiator R there is in principal placed a fan or blower S which may advantageously be driven mechanically.

In accordance with the present invention, the bottom portion of the expansion-tank V is connected through a pipe 1 to the suction of an auxiliary electric injection pump 2 of small size but nevertheless having a significant delivery, for example, 30 to 60 l/h. In comparison, the main circulating pump P has a delivery of the order of 500 to 1000 l/h. This electric injection pump 2 delivers into an auxiliary pipe 3 which is equipped with a non-return valve 4 and which opens into the cooling circuit L of the engine M at the suction of the main pump P (as illustrated) or as a variant, either further upstream at the inlet to the radiator R, or further downstream at the delivery from the pump P. The valve 4 may be incorporated into the electric pump 2 and similarly the assembly 2–4 may be incorporated into the expansion-tank V.

The electric supply circuit 5 to the auxiliary pump 2 comprises in series with a source 6 (for example, the battery of the vehicle), a thermal probe such as a thermocontact 7 sensitive to the temperature of the cooling liquid of the engine M. As soon as the latter reaches a certain level which is not to be exceeded (for example, a temperature close to 100° C.), the contact 7 closes and the auxiliary injection pump 2 is set running, delivering cold liquid coming from the expansion-tank V and injecting it into the cooling circuit L of the engine M.

If the fan S is driven mechanically from the engine M through a declutchable coupling or if it is driven by an electric motor having a controlled supply, the thermal contact 7 may be arranged so that it closes consecutively; first of all for a water temperature T1 (for example, 98°) a first circuit (not shown) for controlling the fan S in a known manner; then for a water temperature T2 (for example, 106°) the electric circuit 5 for control of the auxiliary injection pump 2.

In short, the thermal inertia of the engine M as it emerges during the passing from full load running to slow running, appears as a rise in temperature of the cooling water or other liquid. Such a rise in temperature is detected by the thermal probe having the thermal contact 7 which controls the starting up:

of the fan S in the case of the engine equipped with a controlled electric fan or declutchable mechanical fan, at the first temperature threshold T1; and of the injection pump 2 at the second temperature threshold T2.

The cold liquid in the expansion-tank V is drawn by the pump 2 through the pipe 1 and then injected at the inlet to the engine M towards the suction (or as a variant, the delivery) of the main pump P through the pipe 3. The cold liquid thus injected is going to be mixed with the hot liquid in the engine M and therefore absorbs the effect of its thermal inertia. The liquid temperature at the outlet from the engine M decreases progressively or remains constant as a function of the time. The injection pump 2 stops only if the liquid temperature at the outlet from the engine M reaches the predetermined threshold detected by the thermal contact 7.

It will be observed that the amount of cold liquid coming from the expansion-tank V and thus injected into the cooling circuit L of the engine M, displaces an equivalent amount of liquid at a higher temperature which leaving the header of the radiator R passes through the pipe C in order to enter the expansion-tank V. The latter like the pipe C will advantageously be of a material which favours heat exchange, and they will be placed at a well ventilated place in the vehicle. The pipe C will preferably be equipped with fins 8, again in order to favour heat exchange.

In short, the result is a transfer of heat energy with a time constant close to the thermal inertia of the engine.

As the phenomenon of violent overheating explained above is only very episodic and in principle is not repeated at short intervals of time, the unit which has jut been described is ready to intervene at any moment, as soon as the temperature threshold of the liquid is reached, this being in spite of the small capacity of the expansion-tank V (from 1 to 2 liters).

The problem of effective cooling of the engine M during slow running being solved in that way, the construction of the radiator R of a bundle of finned tubes is freed from the usual restraints which compel considerable intervals to be arranged between the fins in order to allow effective passage of the cooling air. Thanks to the present invention, the fins can be closed up considerably or in other words the pitch of them can be reduced, which enables better performance of the radiator R to be obtained at high load without prejudicing the cooling during slow running.

In the foregoing, reference has been made to passing from full load running of the engine M to slow running with correlatively an abrupt increase in temperature detected by the probe 7 for starting the auxiliary pump 2. It goes without saying that these same phenomena will likewise occur if instead of passing to slow running of the engine M it is stopped completely, the vehicle being at rest, for example, in the garage; in this case likewise, the auxiliary pump 2 will be started up if overheating is detected by the probe 7.

We claim:

1. Method for preventing overheat of relatively hot coolant liquid of an automobile engine upon sudden drop of ventilation due to either slow down or stop of the automobile after intense running, which coolant liquid is contained in a cooling hydraulic circuit comprising on the one hand a loop including in series flow relationship a circulating pump, said engine and a ventilated radiator and on the other hand an external expansion tank in a hydraulic circuit branch extending from said loop and containing an amount of relatively cold coolant liquid, said method comprising the steps of:

sucking relatively cold coolant liquid from the expansion tank externally of said loop; and pumping the sucked relatively cold coolant liquid into the relatively hot coolant liquid in the loop of the hydraulic circuit at an injection location thereof between the radiator and the engine.

2. Method as recited in claim 1, comprising the further steps of sensing the relatively high liquid temperature in the hydraulic circuit loop at a position thereof between the engine and the radiator, and triggering the relatively cold liquid sucking and pumping steps upon the sensed temperature reaching a first predetermined threshold value close to the boiling point of the liquid.

3. Method as recited in claim 2, comprising the further step of checking at a point between the injection location and the expansion tank any back flow of relatively hot coolant liquid from the engine.

4. Method as recited in claim 2, wherein the injection location where the relatively cold coolant liquid is pumped into the hydraulic circuit loop is arranged at a position thereof upstream of the circulating pump.

5. Method as recited in claim 2, comprising the further step of passing the coolant liquid into a cooling heat exchange relationship with ambient air, in a portion of the hydraulic circuit branch extending from the loop to the expansion tank.

6. Method as recited in claim 2, comprising the further step of initiating forced ventilation of the radiator upon the sensed temperature reaching a second predetermined threshold value.

7. Method as recited in claim 6, wherein the second threshold value is a few degrees lower than the first threshold value.

8. Method as recited in claim 5, wherein said hydraulic circuit branch includes in series flow relationship cooling fins, said expansion tank and an auxiliary pump.

* * * * *